US009059534B2

(12) United States Patent
Endo et al.

(10) Patent No.: US 9,059,534 B2
(45) Date of Patent: Jun. 16, 2015

(54) SHIELD CONNECTOR

(75) Inventors: Takuya Endo, Makinohara (JP); Kouichi Nakayama, Makinohara (JP); Tsuyoshi Mizushima, Makinohara (JP)

(73) Assignee: Yazaki Corporation, Tokyo (JP)

( * ) Notice: Subject to any disclaimer, the term of this patent is extended or adjusted under 35 U.S.C. 154(b) by 46 days.

(21) Appl. No.: 14/006,175

(22) PCT Filed: Mar. 21, 2012

(86) PCT No.: PCT/JP2012/001923
§ 371 (c)(1),
(2), (4) Date: Sep. 19, 2013

(87) PCT Pub. No.: WO2012/127855
PCT Pub. Date: Sep. 27, 2012

(65) Prior Publication Data

US 2014/0011401 A1 Jan. 9, 2014

(30) Foreign Application Priority Data

Mar. 22, 2011 (JP) ..... 2011-061995

(51) Int. Cl.
*H01R 13/52* (2006.01)
*H01R 9/03* (2006.01)
*H01R 105/00* (2006.01)

(52) U.S. Cl.
CPC ..... *H01R 13/52* (2013.01); *H01R 9/032* (2013.01); *H01R 13/5205* (2013.01); *H01R 2105/00* (2013.01)

(58) Field of Classification Search
CPC ..... H01R 13/52; H01R 13/5202; H01R 13/5205; H01R 13/5208; H01R 13/521
See application file for complete search history.

(56) References Cited

U.S. PATENT DOCUMENTS 6,270,377 B1 * 8/2001 Miyazaki et al. ..... 439/607.41
6,280,208 B1 * 8/2001 Masuda et al. ..... 439/98

(Continued)

FOREIGN PATENT DOCUMENTS

CN 201690055 U 12/2010
JP 2009-123584 A 6/2009
JP 2010-225371 A 10/2010

OTHER PUBLICATIONS

International Search Report and Written Opinion dated May 25, 2012, issued for PCT/JP2012/001923.

(Continued)

*Primary Examiner* — Ross Gushi
(74) *Attorney, Agent, or Firm* — Locke Lord LLP

(57) ABSTRACT

There is provided a shield connector that allows reliable prevention of a rubber plug from being detached from a housing. A shield connector has a terminal fitting connected to an end of an electrical wire, a housing accommodating the terminal fitting, a shield shell covering the housing, and a rubber plug attached to an outer circumference of the electrical wire for waterproofing of the inner space of the housing. The shield shell includes an electrical-wire insertion hole through which the electrical wire is passed. The rubber plug includes a packing and a resin member made in one piece with the packing. The resin member includes a cylindrical body and a flange portion protruding from an outer circumferential surface of the cylindrical body. An end of the cylindrical body is in the electrical-wire insertion hole, and the flange portion is sandwiched by the housing and the electrical-wire insertion hole.

2 Claims, 7 Drawing Sheets

(56) References Cited

U.S. PATENT DOCUMENTS 6,464,538 B2 * 10/2002 Miyazaki et al. ..... 439/607.44
6,583,352 B2 * 6/2003 Fukushima et al. ..... 174/373
6,595,789 B2 * 7/2003 Oota et al. ..... 439/98
6,655,989 B1 * 12/2003 Gale et al. ..... 439/559
6,702,612 B2 * 3/2004 Miyazaki et al. ..... 439/559
6,716,071 B2 * 4/2004 Miyazaki ..... 439/859
6,814,617 B2 * 11/2004 Oota et al. ..... 439/589
6,815,610 B2 * 11/2004 Kuboshima et al. ..... 174/360
6,821,160 B2 * 11/2004 Fink et al. ..... 439/701
6,837,728 B2 * 1/2005 Miyazaki et al. ..... 439/271
6,921,292 B2 * 7/2005 Miyazaki ..... 439/564
6,945,817 B2 * 9/2005 Miyazaki et al. ..... 439/579
6,953,357 B2 * 10/2005 Fukushima et al. ..... 439/271
7,041,907 B2 * 5/2006 Miyazaki ..... 174/72 A
7,059,918 B2 * 6/2006 Matsumoto et al. ..... 439/752
7,070,449 B2 * 7/2006 Miyazaki ..... 439/587
7,077,676 B2 * 7/2006 Matsumoto et al. ..... 439/271
7,094,098 B2 * 8/2006 Miyazaki ..... 439/559
7,097,498 B2 * 8/2006 Miyazaki ..... 439/559
7,101,217 B2 * 9/2006 Hayashi ..... 439/447
7,165,995 B2 * 1/2007 Fukushima et al. ..... 439/607.58
7,264,506 B2 * 9/2007 Mori et al. ..... 439/606
7,268,300 B2 * 9/2007 Miyazaki ..... 174/138 F
7,306,475 B2 * 12/2007 Tsuruta et al. ..... 439/364
7,329,145 B2 * 2/2008 Yagome et al. ..... 439/556
7,393,218 B1 * 7/2008 Pavlovic et al. ..... 439/97
7,572,150 B2 * 8/2009 Matsuoka ..... 439/626
7,597,580 B1 * 10/2009 Advey et al. ..... 439/383
7,597,589 B2 * 10/2009 Kawamura ..... 439/595
7,614,910 B2 * 11/2009 Croteau et al. ..... 439/573
7,618,286 B2 * 11/2009 Aoki et al. ..... 439/587
7,637,761 B1 * 12/2009 Arnold ..... 439/212
7,645,157 B2 * 1/2010 Mizutani et al. ..... 439/382
7,722,372 B2 * 5/2010 Matsumoto et al. ..... 439/213
7,811,116 B2 * 10/2010 Sakakura et al. ..... 439/364
7,828,591 B2 * 11/2010 Matsuoka ..... 439/559
7,959,468 B2 * 6/2011 Yong et al. ..... 439/607.41
7,959,469 B2 * 6/2011 Kawamura et al. ..... 439/607.55
7,988,475 B2 * 8/2011 Sakakura ..... 439/271
8,128,431 B2 * 3/2012 Kato et al. ..... 439/587
8,152,574 B2 * 4/2012 Matsuoka et al. ..... 439/801
8,167,653 B2 * 5/2012 Hasegawa et al. ..... 439/607.41
8,177,584 B2 * 5/2012 Matsuoka ..... 439/587
8,187,030 B2 * 5/2012 Matsuoka et al. ..... 439/542
8,257,096 B2 * 9/2012 Matsuoka et al. ..... 439/76.2
8,257,107 B2 * 9/2012 Tsuruta et al. ..... 439/362
8,317,544 B2 * 11/2012 Matsuoka et al. ..... 439/607.55
8,328,572 B2 * 12/2012 Tashiro ..... 439/271
8,342,880 B2 * 1/2013 Kato et al. ..... 439/595
8,366,470 B2 * 2/2013 Sakakura ..... 439/272
8,393,911 B2 * 3/2013 Aoki et al. ..... 439/272
8,395,047 B2 * 3/2013 Adachi et al. ..... 174/74 R
8,408,943 B2 * 4/2013 Okamoto ..... 439/607.55
8,449,323 B2 * 5/2013 Omae et al. ..... 439/559
8,485,844 B2 * 7/2013 Omae et al. ..... 439/559
8,545,265 B2 * 10/2013 Sakamoto et al. ..... 439/606
8,556,660 B2 * 10/2013 Matsuoka et al. ..... 439/626
8,562,377 B2 * 10/2013 Kawamura ..... 439/607.44
8,562,381 B2 * 10/2013 Kawamura ..... 439/801
8,579,655 B2 * 11/2013 Kawamura ..... 439/509
8,597,062 B2 * 12/2013 Casses et al. ..... 439/686
8,608,515 B2 * 12/2013 Tate et al. ..... 439/686
8,641,441 B2 * 2/2014 Aoki et al. ..... 439/345
8,641,444 B2 * 2/2014 Yoshida et al. ..... 439/487
8,662,920 B2 * 3/2014 Ishibashi et al. ..... 439/564
8,672,700 B2 * 3/2014 Matsumoto et al. ..... 439/364
8,747,157 B2 * 6/2014 Tashiro ..... 439/595
8,764,481 B2 * 7/2014 Matsumoto et al. ..... 439/595
8,771,013 B2 * 7/2014 Kalayjian et al. ..... 439/585
8,790,135 B2 * 7/2014 Maegawa ..... 439/587
8,803,006 B2 * 8/2014 Imahori et al. ..... 174/539
8,827,729 B2 * 9/2014 Gunreben et al. ..... 439/188
8,851,935 B2 * 10/2014 Yoshioka et al. ..... 439/694
8,894,449 B2 * 11/2014 Matsumoto et al. ..... 439/727
2002/0048994 A1 * 4/2002 Oota et al. ..... 439/607
2002/0132522 A1 * 9/2002 Miyazaki et al. ..... 439/559
2006/0063412 A1 * 3/2006 Matsumoto et al. ..... 439/274
2007/0184701 A1 * 8/2007 Yagome et al. ..... 439/271
2009/0124121 A1 * 5/2009 Matsuoka ..... 439/550
2009/0130901 A1 5/2009 Aoki et al.
2009/0137153 A1 * 5/2009 Yoshioka et al. ..... 439/607.24
2010/0159743 A1 * 6/2010 Kato et al. ..... 439/587
2010/0216323 A1 * 8/2010 Kawamura et al. ..... 439/95
2010/0255728 A1 * 10/2010 Matsuoka et al. ..... 439/607.55
2010/0261363 A1 * 10/2010 Sakakura ..... 439/271
2010/0261364 A1 * 10/2010 Matsuoka ..... 439/271
2011/0014822 A1 * 1/2011 Kato et al. ..... 439/733.1
2011/0117784 A1 * 5/2011 Matsuoka et al. ..... 439/626
2011/0187213 A1 * 8/2011 Kitagawa et al. ..... 310/71
2011/0316373 A1 * 12/2011 Kobayashi et al. ..... 310/71
2012/0021632 A1 * 1/2012 Matsumoto et al. ..... 439/271
2012/0021645 A1 * 1/2012 Marsh ..... 439/578
2012/0164867 A1 * 6/2012 Matsumoto et al. ..... 439/345
2012/0178291 A1 * 7/2012 Matsumoto et al. ..... 439/588
2012/0184155 A1 * 7/2012 Matsumoto et al. ..... 439/709
2012/0208404 A1 * 8/2012 Matsumoto et al. ..... 439/661
2012/0238134 A1 * 9/2012 Matsuoka et al. ..... 439/587
2012/0238143 A1 * 9/2012 Matsuoka et al. ..... 439/626
2012/0238147 A1 * 9/2012 Matsumoto et al. ..... 439/660
2012/0238149 A1 * 9/2012 Tate et al. ..... 439/660
2012/0238150 A1 * 9/2012 Sakamoto et al. ..... 439/660
2012/0292101 A1 * 11/2012 Kato ..... 174/72 A
2013/0017719 A1 * 1/2013 Tanaka et al. ..... 439/587
2013/0040473 A1 * 2/2013 Tanaka et al. ..... 439/86
2013/0092412 A1 * 4/2013 Tanaka et al. ..... 174/78
2013/0095704 A1 * 4/2013 Awakura et al. ..... 439/709
2013/0168150 A1 * 7/2013 Sakakura ..... 174/650
2013/0260585 A1 * 10/2013 Wang ..... 439/271
2013/0316579 A1 * 11/2013 Nakayama et al. ..... 439/607.01
2014/0011401 A1 * 1/2014 Endo et al. ..... 439/588
2014/0011408 A1 * 1/2014 Nakayama et al. ..... 439/733.1
2014/0106588 A1 * 4/2014 Suzuki et al. ..... 439/271
2014/0120767 A1 * 5/2014 Itsuki et al. ..... 439/587
2014/0148045 A1 * 5/2014 Kashiwada et al. ..... 439/485
2014/0179161 A1 * 6/2014 Imahori ..... 439/607.45
2014/0248793 A1 * 9/2014 Nakamura et al. ..... 439/519
2014/0287631 A1 * 9/2014 Tashiro et al. ..... 439/733.1
2014/0322973 A1 * 10/2014 Okamoto et al. ..... 439/587

OTHER PUBLICATIONS

Office Action mailed Mar. 31, 2015, issued for the Chinese patent application No. 201280014187.X and English translation thereof.

* cited by examiner

SHIELD CONNECTOR

TECHNICAL FIELD

The present invention relates to a shield connector having a housing accommodating a terminal fitting and a shield shell covering the housing.

BACKGROUND ART

FIG. 10 is a cross-sectional view of a state of the art shield connector (see the patent literature PTL 1). The conventional shield connector 340 comprises a terminal fitting 303 connected to an end of an electrical wire 330, a housing 311 accommodating the terminal fitting 303, a shield shell 312 covering a housing 311, and a rubber plug 341 attached on an outer circumferential surface of the electrical wire 330 for waterproofing of an inner space of the housing 311. The electrical wire 330 is covered by not-shown cylindrical braided conductor and thereby electromagnetically shielded. The braided conductor is electrically connected to the shield shell 312.

The terminal fitting 303 may be obtained by press working of a metallic plate. The terminal fitting 303 comprises an electrical contact 331 adapted to be electrically connected to a terminal fitting of a mating connector and an electrical wire connecting portion 334 adapted to be electrically connected to the electrical wire 330.

The housing 311 includes a housing body 315 made of insulating resin. The housing body 315 includes a cavity 317 in which the terminal fitting 303, the end of the electrical wire 330 connected to the terminal fitting 303, and the rubber plug 341 attached to the outer circumferential surface of the electrical wire 330.

The shield shell 312 is made of conductive metal. The shield shell 312 includes abase plate 323 continuing to the rear end of the housing body 315 and a circular ring portion 322 protruding from an outer edge of the base plate 323. The base plate 323 includes an electrical-wire insertion hole 327 through which the electrical wire 330 is passed.

The rubber plug 341 comprises a rubber plug body 342 made of rubber and a stiff resin member 343 embedded in the rubber plug body 342. The resin member 343 includes an extended portion 344 protruding from an end of the rubber plug body 342, the end being defined with reference to the axis of the rubber plug body 342, toward the outside of the rubber plug body 342. This end of the rubber plug body 34 of the rubber plug 341 is adapted to be brought into abutment on an outer edge of the electrical-wire insertion hole 327 in the shield shell 312 so that the extended portion 344 is positioned inside of the electrical-wire insertion hole 327.

CITATION LIST

Patent Literature

[PTL 1]
Japanese Patent Application Laid-Open Publication No. 2009-123584

SUMMARY OF INVENTION

Technical Problem

The above-described conventional shield connector 340 has the following drawback. Specifically, the configuration of the shield connector 340 for protecting the rubber plug 341 against being inadvertently taken out of the cavity 327 relies on the abutment of the end of the rubber plug body 342 on the outer edge of the electrical-wire insertion hole 327 in the shield shell 312. Meanwhile, since the rubber plug body 342 is an elastically deformable member, abutment of the end of the rubber plug body 342 on the outer edge of the electrical-wire insertion hole 327 may be insufficient for the rubber plug 341 to be protected against inadvertent detachment from the cavity 317.

In view of the above identified drawback, an object of the present invention is to provide a shield connector that allows reliable prevention of detachment of the rubber plug from the housing.

Solution to Problem

In order to attain the above objective, a first aspect of the invention provides a shield connector comprising: (a) a terminal fitting connected to an end of an electrical wire; (b) a housing accommodating the terminal fitting; (c) a shield shell covering the housing, the shield shell having an electrical-wire insertion hole through which the electrical wire is passed; and (d) a rubber plug attached on an outer circumference of the electrical wire for waterproofing of the housing. The rubber plug includes a packing and a resin member made in one piece with the packing. The resin member includes a cylindrical body and a flange portion protruding in a flange-like manner from an outer circumferential surface of the cylindrical body. An end of the cylindrical body is positioned in the electrical-wire insertion hole, the end being defined with reference to an axis of the cylindrical body. The flange portion is brought into abutment on an outer edge of the electrical-wire-insertion hole.

In accordance with a second aspect of the invention, in the context of the first aspect, the resin member further includes a secondary cylindrical body extending from an other end of the cylindrical body and having inner and outer diameters smaller than those of the cylindrical body, the other end being defined with reference to the axis of the cylindrical body. The packing comprises (a) an inner cylindrical portion arranged in the cylindrical body to be in contact with an inner circumference of the cylindrical body; (b) an inner circumferential lip protruding from the inner cylindrical portion and being firmly attached to an outer circumferential surface of the electrical wire; (c) an outer cylindrical portion arranged on an outer circumference of the secondary cylindrical body; and (d) an outer circumferential lip protruding from the outer cylindrical portion and being firmly attached to an inner surface of the housing, and a gap is provided between the secondary cylindrical body and the inner circumferential lip.

In accordance with a third aspect of the invention, in the context of the first or second aspect thereof, the flange portion is sandwiched by the housing and the outer edge of the electrical-wire insertion hole.

Advantageous Effects of Invention

The invention defined in accordance with the first aspect thereof has the following advantageous effects: Since the end of the cylindrical body is positioned in the electrical-wire insertion hole and the flange portion is in abutment on the outer edge of the electrical-wire insertion hole, it is made possible to provide a shield connector that can effectively prevent the rubber plug from detached from the housing.

The invention defined in accordance with the second aspect thereof has the following advantageous effects: Since there is the gap between the secondary cylindrical body and the inner circumferential lip, it is made possible to prevent the inner circumferential lip from being pressed against the secondary cylindrical body in the course of mounting of the electrical wire and thereby prevent cutting of the inner circumferential lip.

The invention defined in accordance with the third aspect thereof has the following advantageous effects: Since the flange portion is sandwiched between the housing and the electrical-wire insertion hole, it is made possible to provide a shield connector that can effectively prevent detachment of the rubber plug from the housing and prevent displacement of the rubber plug within the housing.

DESCRIPTION OF EMBODIMENTS

The following describes a shield connector according to one embodiment of the invention with reference to FIGS. 1 to 7.

Figure 1:
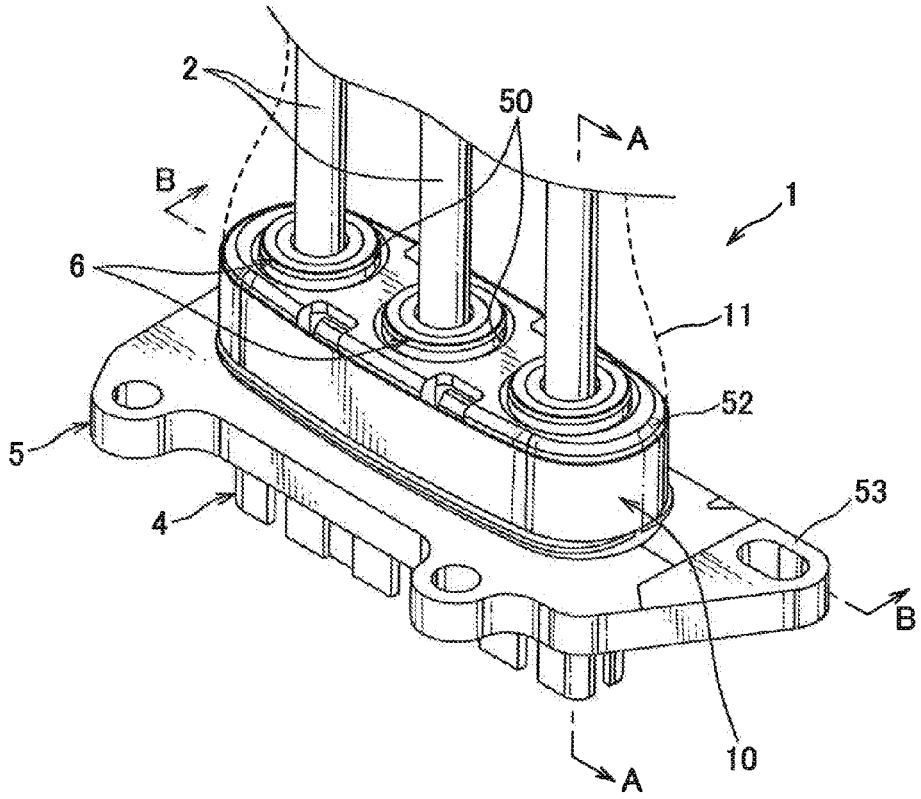
FIG. 1 is a perspective view of a shield connector according to one embodiment of the present invention.
Figure 2:
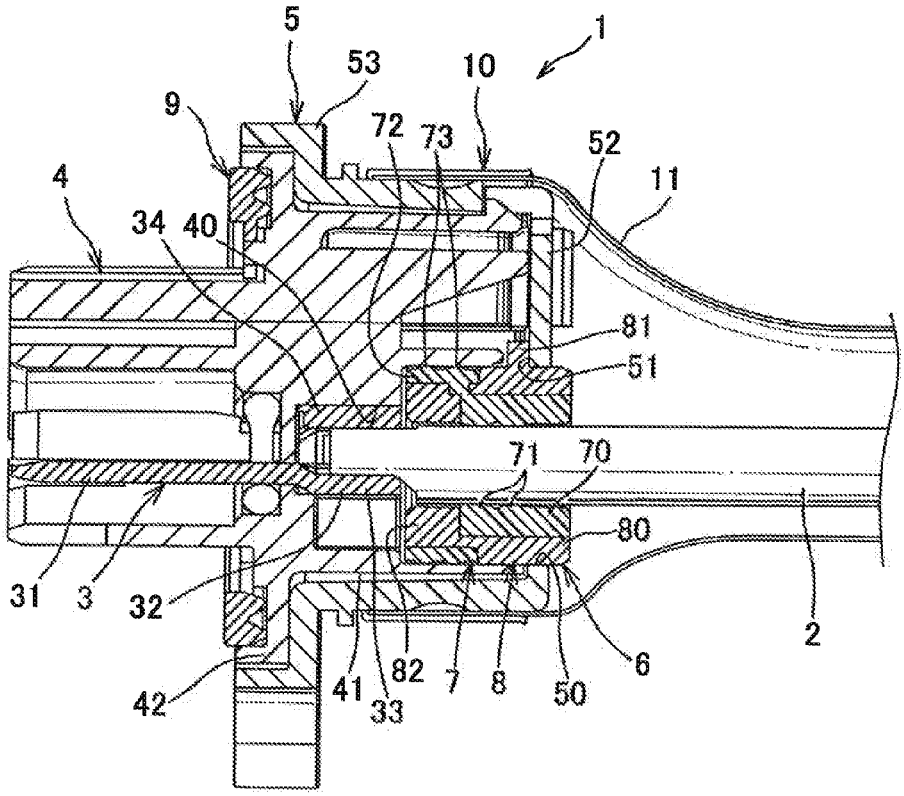
FIG. 2 is a cross-sectional view taken along the line A-A in FIG. 1.
Figure 3:
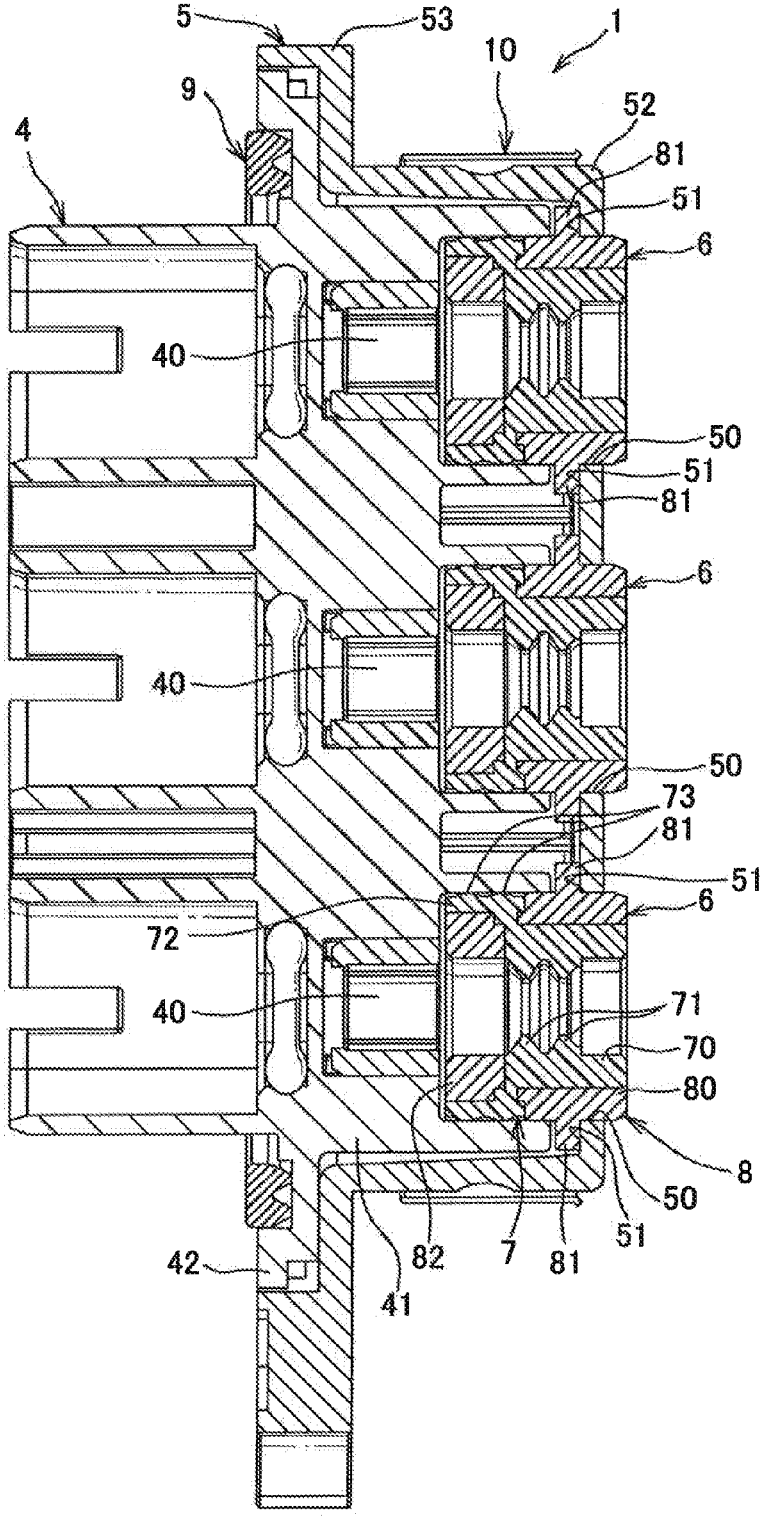
FIG. 3 is a cross-sectional view taken along the line B-B in FIG. 3.
Figure 4:
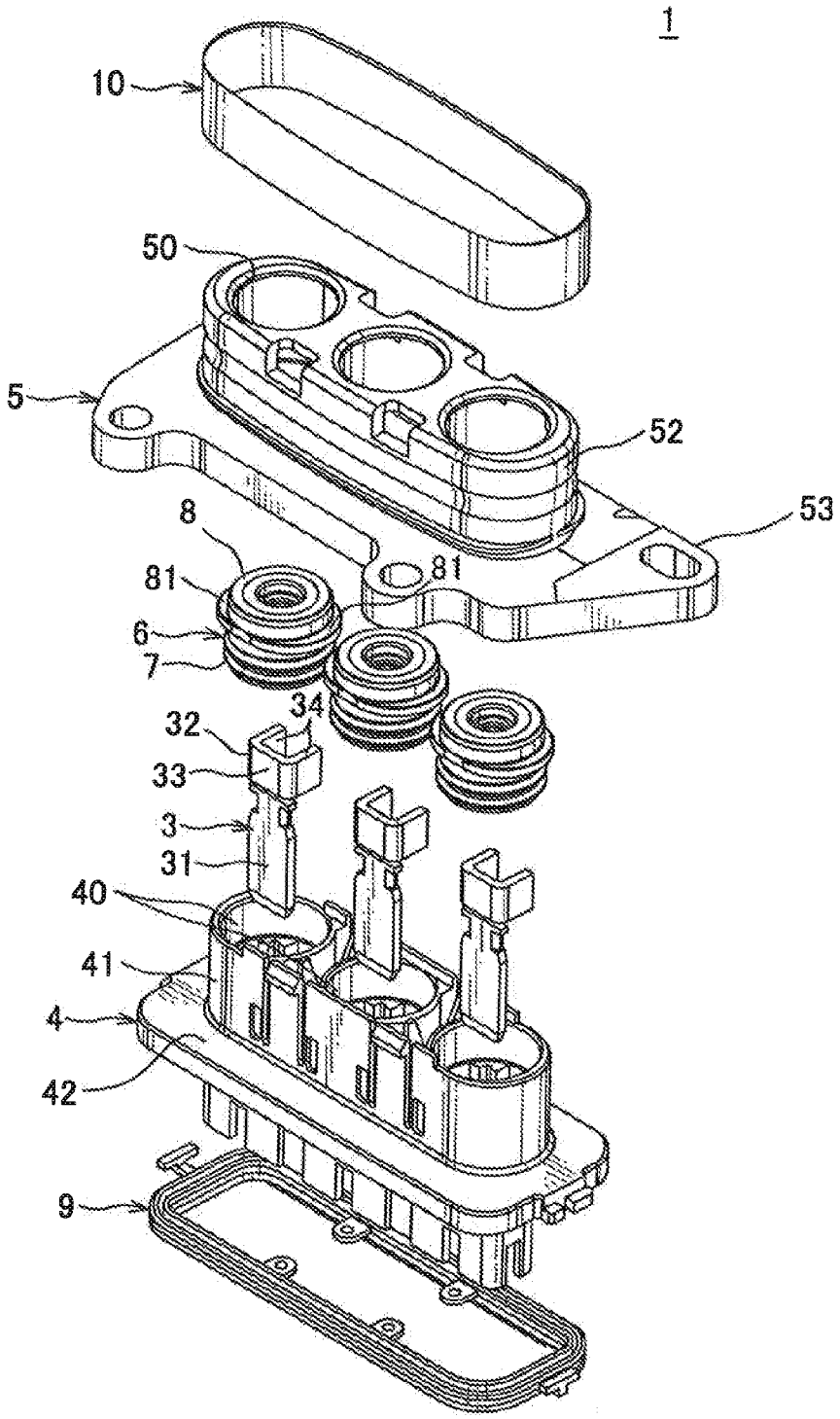
FIG. 4 is an exploded view of the shield connector illustrated in FIG. 1.

Referring to FIGS. 1 to 4, there is shown a shield connector 1 comprising: (a) a plurality of terminal fittings 3 each connected to corresponding each of ends of electrical wires 2; (b) a housing 4 adapted to accommodate therein the terminal fittings 3; (c) a shield shell 5 adapted to cover the housing 4, (d) a plurality of rubber plugs 6 each adapted to be attached to corresponding each of outer circumferences of the electrical wires 2 for waterproofing of an inner space of the housing 4; (e) a ring 10 adapted to secure a cylindrical braided conductor 11 to the shield shell 5, the cylindrical braided conductor 11 being adapted to cover the electrical wire 2; and (f) a waterproof packing 9 adapted to be attached to the housing 4. In FIG. 3, the terminal fitting 3 and the electrical wire 2 are not illustrated for simplicity.

The electrical wire 2 is a sheathed electrical wire with a circular cross section. The electrical wire 2 comprises a core wire and an insulating sheath covering the core wire. An end of the electrical wire 2 is stripped of the insulating sheath so that the core wire is exposed. The stripped end of the electrical wire 2 has a beveled edge so as not to cause damage to a later-described inner circumferential lip 71 of the rubber plug 6 in the course of mounting operation of the rubber plug 6. Also, the electrical wires 2 are covered by the cylindrical braided conductor 11 and thereby electromagnetically shielded.

The terminal fitting 3 may be obtained by press working of a metallic plate. The terminal fitting 3 comprises (i) an electrical contact 31 adapted to be electrically connected to a terminal fitting of a mating connector (not shown), and (ii) an electrical wire connecting portion 32 adapted to be electrically connected to the core wire of the electrical wire 2. The electrical wire connecting portion 32 includes a base plate 33 continuing to the electrical contact 31, and a pair of press-fit pieces 34 provided at and extending from both ends widthwise of the base plate 33. The core wire of the electrical wire 2 is press-fitted to the electrical wire connecting portion 32 by positioning the core wire on the base plate 33 and caulking the core wire via the pair of press-fit pieces 34.

The housing 4 is made of insulating synthetic resin. The housing 4 comprises (i) a housing body 41 having a plurality of cavities 40 therein and (ii) a flange portion 42 protruding in a ring-like manner on an outer circumference of the housing body 41. The terminal fitting 3, the end of the electrical wire 2 connected to the terminal fitting 3, and the rubber plug 6 attached to the outer circumference of the electrical wire 2 are accommodated together in the cavity 40. Also, a housing of the not-shown mating connector is brought into fitting engagement with the end of the housing body 41 which should appear in the center left portion of FIG. 2. The waterproof packing 9 is made of an elastically deformable synthetic resin and formed in a shape of a ring. The waterproof packing 9 is adapted to be mounted in a recessed groove provided in the flange portion 42.

The shield shell 5 is made of conductive metal. The shield shell 5 comprises (i) a first cover portion 52 adapted to cover a rear portion of the housing body 41, i.e., the side away from the mating connector, and (ii) a second cover portion 53 adapted to cover the flange portion 42. The first cover portion 52 includes a plurality of electrical-wire insertion holes 50 through which the electrical wires 2 each drawn out of the corresponding cavity 40 are passed.

Figure 5:
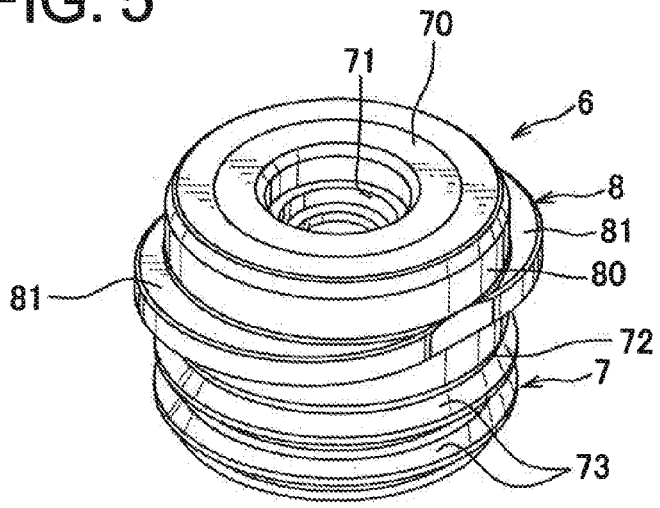
FIG. 5 is a perspective view of a rubber plug constituting the shield connector illustrated in FIG. 1.

Referring to FIG. 5, the rubber plug 6 comprises (i) a packing 7 made of elastically deformable synthetic resin such as rubber, and (ii) a resin member 8 made of synthetic resin stiffer and harder-to-be-elastically-deformed than that of the packing 7. The packing 7 and the resin member 8 may be made in one piece by insert molding.

Figure 6:
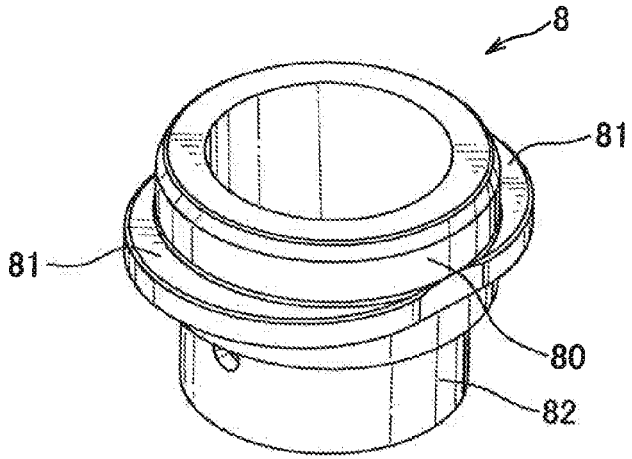
FIG. 6 is a perspective view of a resin member constituting the rubber plug illustrated in FIG. 5.
Figure 7:
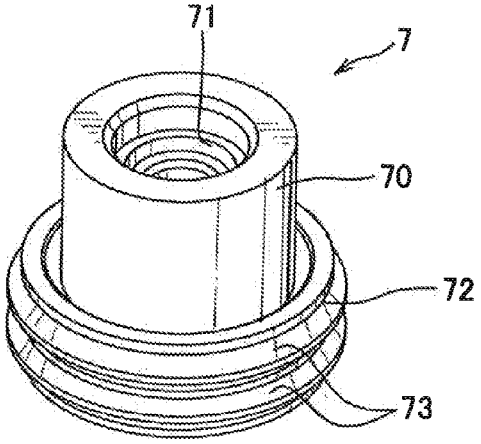
FIG. 7 is a perspective view of a packing constituting the rubber plug illustrated in FIG. 5.

Referring to FIG. 6, the resin member 8 includes a cylindrical body 80; a pair of flange portions 81 protruding in a flange-like manner from part of an outer circumferential surface of the cylindrical body 80; and a secondary cylindrical body 82 extended from the other end of the cylindrical body 80 along the axis of the cylindrical body 80, the secondary cylindrical body 82 having inner and outer diameters smaller than those of the cylindrical body 80.

The packing 7 includes (i) an inner cylindrical portion 70 adapted to be arranged in the cylindrical body 80 to be in contact with its inner circumferential surface, (ii) an inner circumferential, lip 71 protruding from the inner cylindrical portion 70 and adapted to be firmly attached to the outer circumferential surface of the electrical wire (iii) an outer cylindrical portion 72 adapted to be arranged on the secondary cylindrical body 82 to be in contact with its outer circumference, and (iv) an outer circumferential lip 73 protruding from the outer cylindrical portion 72 and adapted to be firmly attached to an inner surface of the housing 4, i.e., the surface where the cavity 40 is provided. Also, the inner circumferential lip 71 and the outer circumferential lip 73 are formed in a shape of a circular ring. Further, there are provided two each of the inner circumferential lips 71 and the outer circumferential lips 73, respectively.

Referring to FIG. 3, an end of the cylindrical body 80 of the rubber plug 6 along the axis thereof is positioned inside of the electrical-wire insertion hole 50, and the pair of flange portions 81 are in abutment on an outer edge 51 of the electrical-wire insertion hole 50. The pair of flange portions 81 is sandwiched by a rear end of the housing body 41, i.e., the end on the side away from the mating connector, and the outer edge 51 of the electrical-wire insertion hole 50. Further, the remaining section other than the axially one end of the cylindrical body 80 and the pair of flange portions 81 are positioned in the cavity 40.

By virtue of the pair of stiff-resin flange portions 81 brought into abutment on the outer edge 51 of the electrical-wire insertion hole 50, the present invention makes it possible to effectively prevent the rubber plug 6 from being taken out of the cavity 40 of the housing 4. In addition, by virtue of the pair of flange portion 81 sandwiched between the rear end of the housing body 41 and the outer edge 51 of the electrical-wire insertion hole 50, it is made possible to prevent displacement of the rubber plug 6 within the cavity 40 of the housing 4. In this manner, the invention, by virtue of the shield shell 5, ensures prevention of detachment of the rubber plug 6 from the housing 4. This means that the invention does not need to provide a dedicated rubber-plug-detachment-prevention member, which contributes to reduction in the number of components.

Further, according to the present invention, the rubber plug 6 is used not only to making the housing 4 waterproof, but also secure the terminal fitting 3 to the housing 4. In other words, the shield connector 1 does not need to include a locking lance in the housing 4 to secure the terminal fitting 3 to the housing, for the rubber plug 6 is attached to the electrical wire 2 connected to the terminal fitting 3 and then the rubber plug 6 is sandwiched by the housing 4 and the shield shell 5 to be secured thereto. Accordingly, the rubber plug 6 is adapted to prevent the terminal fitting 3 from being taken out of the cavity 40. In addition, the housing 4 does not include a locking lance for prevention of detachment of the terminal fitting 3 therefrom. This configuration facilitates miniaturization of the housing 4.

Referring to FIG. 2, the ring 10 is attached to an outer circumference of the first cover portion 52 of the shield shell 5 such that the end of the braided conductor 11 is sandwiched by the ring 10 and the first cover portion 52.

The shield connector 1 having the above-described configuration is assembled in the following manner. First, the waterproof packing 9 is attached to the flange portion 42 of the housing 4. Next, the electrical wire 2 having the end stripped of the insulating sheath and having the beveled edge is inserted into the electrical-wire insertion hole 50 of the shield shell 5 and passed therethrough, and the electrical wire 2 is inserted into the rubber plug 6. Further, the core wire of the electrical wire 2 is press-fitted by the electrical wire connecting portion 32 of the terminal fitting 3. The terminal fitting 3, rubber plug 6, and electrical wire 2 are inserted into the cavity 40 of the housing 4. After that, the shield shell 5 is attached to the housing 4, the first cover portion 52 of the shield shell 5 is covered by the end of the braided conductor 11, and the end of the braided conductor 11 is secured by the ring 10, and thus the shield connector 1 is obtained.

Figure 8:
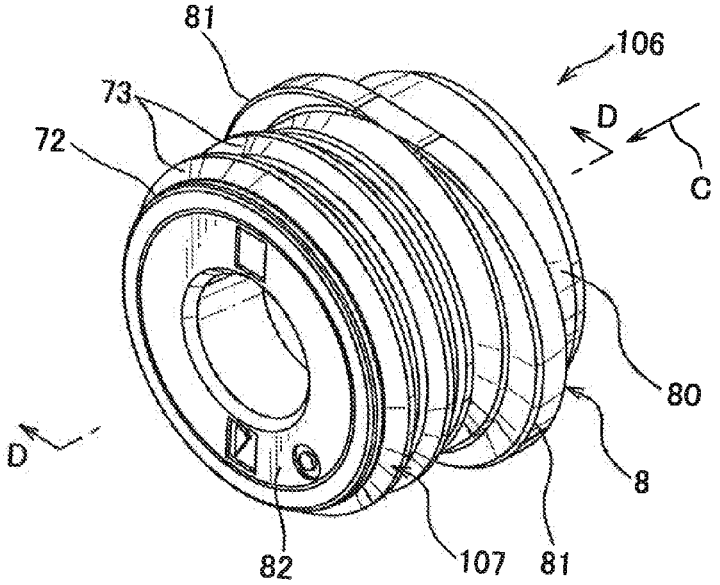
FIG. 8 is a perspective view of a variant configuration for the rubber plug illustrated in FIG. 5.
Figure 9:
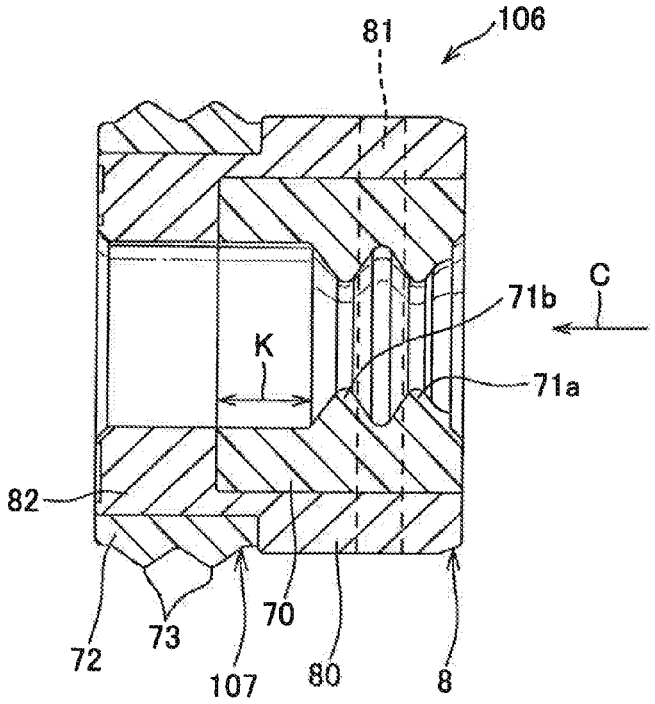
FIG. 9 is a cross-sectional view taken along the line D-D in FIG. 8.
Figure 10:
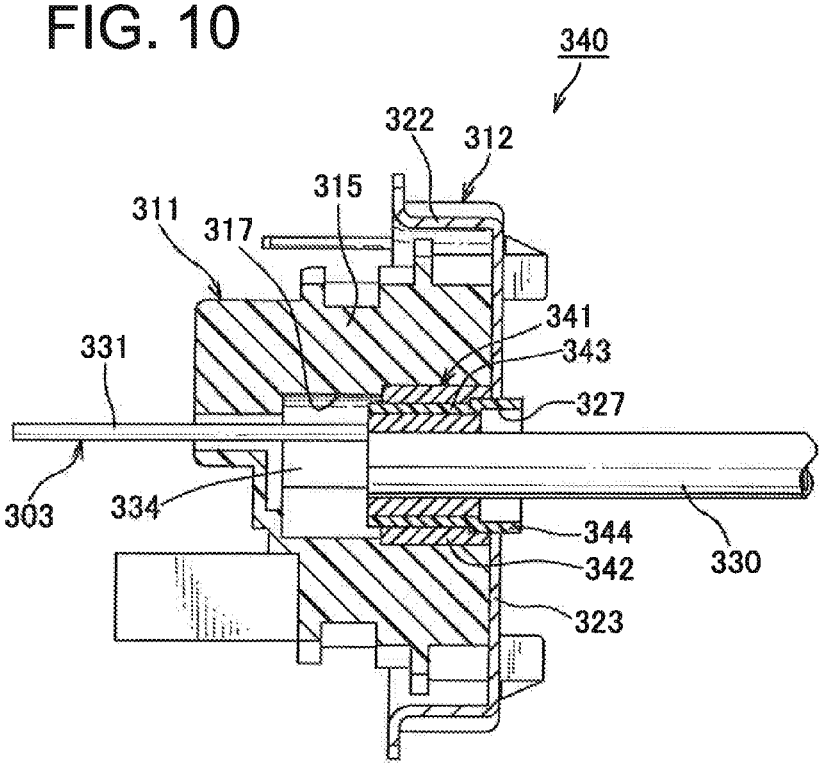
FIG. 10 is a cross-sectional view of a conventional shield connector.

It is also contemplated that the shield connector 1 of the invent on may include a rubber plug 106 illustrated in FIGS. 8, 9 in place of the above-described rubber plug 6. The same or like elements as in FIGS. 8 and 9 are indicated by the same reference sings with detailed description of which is omitted.

The rubber plug 106 includes a packing 107 made of elastically deformable synthetic resin such as rubber, and a resin member 8 made of synthetic resin that is stiffer and harder-to-be-elastically-deformed than that of the packing 107. The packing 107 and the resin member 8 may be made in one piece by insert molding.

The packing 107 comprises an inner cylindrical portion 70 adapted to be arranged inside of the cylindrical body 80 to rest on the inner circumferential surface thereof; inner circumferential lips 71*a*, 71*b* protruding from the inner cylindrical portion 70 so as to be firmly attached to the outer circumferential surface of the electrical wire 2; an outer cylindrical portion 72 arranged on the outer circumferential surface of the secondary cylindrical body 82; and an outer circumferential lip 73 protruding from the outer cylindrical portion 72 to rest on the inner surface of the housing 4. Also, the inner circumferential lips 71*a*, 71*b* and the outer circumferential lip 73 are formed in a shape of a ring. Further, there are provided two each of the inner circumferential lips 71*a*, 71*b* and the outer circumferential lips 73, respectively.

In addition, referring to FIG. 9, the inner circumferential lip 71*b*, which is the more adjacent to the secondary cylindrical body 82 of the two inner circumferential lips 71*a*, 71*b*, is provided spaced from the secondary cylindrical body 82. Specifically, there is provided a gap K between the secondary cylindrical body 82 and the inner circumferential lip 71*b*. Also, the electrical wire 2 is inserted into the rubber plug 106 along the arrow C.

In this manner, the rubber plug 106 of the invention includes the gap K between the secondary cylindrical body 82 and the inner circumferential lip 71*b*, and the inner circumferential lip 71*b* is provided spaced from the secondary cylindrical body 82. This configuration makes it possible to protect the inner circumferential lip 71*b* against being pressed against the secondary cylindrical body 82 in the course of insertion of the electrical wire 2, and thereby prevent cutting of the inner circumferential lip 71*b*. Thus, as described in the foregoing, beveled edge does not need to be provided in the insulating sheath at the end of the insulating sheath.

It is appreciated that the embodiments described herein are representative ones taken out of conceivable embodiments of the invention, and that the invention is in no way limited to the illustrated embodiments. Rather, the invention can be implemented with various modifications made thereto within the range that the spirit of the invention, is deviated from.

REFERENCE SIGNS LIST

1 Shield connector
2 Electrical wire
3 Terminal fitting
4 Housing
5 Shield shell
6, 106 Rubber plug
7, 107 Packing
8 Resin member
50 Electrical-wire insertion hole
51 Outer edge
80 Cylindrical body
81 Flange portion

The invention claimed is:

1. A shield connector comprising:

(a) a terminal fitting connected to an end of an electrical wire;

(b) a housing accommodating the terminal fitting;

(c) a shield shell covering the housing, the shield shell having an electrical-wire insertion hole through which the electrical wire is passed; and (d) a rubber plug attached on an outer circumference of the electrical wire for waterproofing of the housing, the rubber plug including a packing and a resin member made in one piece with the packing, the resin member including a cylindrical body and a flange portion protruding in a flange-like manner from an outer circumferential surface of the cylindrical body, an end of the cylindrical body being positioned in the electrical-wire insertion hole, wherein the end is defined with reference to an axis of the cylindrical body, and the flange portion abutting on an outer edge of the electrical-wire-insertion hole, wherein the flange portion is sandwiched by the housing and the outer edge of the electrical-wire insertion hole.

2. The shield connector as set forth in claim 1, wherein the resin member further includes a secondary cylindrical body extending from an other end of the cylindrical body and having inner and outer diameters smaller than those of the cylindrical body, the other end being defined with reference to the axis of the cylindrical body, the packing includes: (a) an inner cylindrical portion arranged in the cylindrical body to be in contact with an inner circumference of the cylindrical body; (b) an inner circumferential lip protruding from the inner cylindrical portion and being firmly attached to an outer circumferential surface of the electrical wire; (c) an outer cylindrical portion arranged on an outer circumference of the secondary cylindrical body; and (d) an outer circumferential lip protruding from the outer cylindrical portion and being firmly attached to an inner surface of the housing, and a gap is provided between the secondary cylindrical body and the inner circumferential lip.

* * * * *